US005343964A

United States Patent [19]

Leroy

[11] Patent Number: 5,343,964

[45] Date of Patent: Sep. 6, 1994

[54] PETROLEUM, GAS OR GEOTHERMAL DRILING APPARATUS

[76] Inventor: André Leroy, 64 Chaussée de Binche, St Symphorien, B 7030 Mons, Belgium

[21] Appl. No.: 129,170

[22] Filed: Dec. 10, 1993

[30] Foreign Application Priority Data

Apr. 12, 1991 [FR] France ..... 91 04824

[51] Int. Cl.[5] ..... E21B 4/02

[52] U.S. Cl. ..... 175/61; 175/107; 175/325.4

[58] Field of Search ..... 175/61, 107, 325.2, 175/385, 250, 325.4

[56] References Cited

U.S. PATENT DOCUMENTS 2,865,602 12/1958 Whittle .
3,894,818 7/1975 Tschirky ..... 175/107 X
3,989,114 11/1976 Tschirky et al. ..... 175/107
4,270,619 6/1981 Base ..... 175/325.4 X
4,299,296 11/1981 Geczy .
4,485,879 12/1984 Kamp et al. ..... 175/61
4,492,276 1/1985 Kamp ..... 175/61
4,518,051 5/1985 Sollie et al. ..... 175/250
4,597,454 7/1986 Schoeffler ..... 175/61
4,632,193 12/1986 Geezy ..... 175/107
4,862,974 9/1989 Warren et al. .
4,875,531 10/1989 Biehl et al. .

*Primary Examiner*—Thuy M. Bui
*Assistant Examiner*—Frank S. Tsay
*Attorney, Agent, or Firm*—Kerkam, Stowell, Kondracki & Clarke

[57] ABSTRACT

The invention relates to a petroleum, gas or geothermal drilling apparatus comprising a central tool and a coaxial bit, wherein the central tool is driven by the rotor of a bottom engine which is fed by the drilling mud and wherein the bit is driven from the surface by the rods of a drill gear which is part of a rotary system, these same rods subjecting the apparatus to an axial load.

It is characterized in that there is a prismatic connection between the stator (4) of the bottom engine and the base (5) of the bit, which allows the relative axial displacement of the two tools, and that a spring (6) is interposed between the stator (4) and the base (5) in such a way as to form a constraint on the stator when the central tool tends to fall behind in respect to the bit during their respective forward movements, so as to control the relative axial displacement of the two tools and to distribute between them, as a function of the displacement, the axial load to which the apparatus is subjected.

Used in the drilling material industry, namely for petroleum, gas or geothermal drilling.

4 Claims, 3 Drawing Sheets

PETROLEUM, GAS OR GEOTHERMAL DRILING APPARATUS

BACKGROUND OF THE INVENTION

The invention relates to a petroleum, gas or geothermal drilling apparatus comprising a central tool and a coaxial bit, wherein the central tool is driven by the rotor of a bottom engine which is fed by the drilling mud and wherein the bit is driven from the surface by the rods of a drill gear which is part of a rotary system, these same rods subjecting the apparatus to an axial load.

An apparatus is known (U.S. Pat. No. 4,862,974) which conforms to this definition; in such an apparatus the aim of the combined action of the two tools is to utilize the energy contained in the mud to augment the total drilling energy, which is necessary for assuring a sufficient forward speed when the diameter of the wells becomes important.

Another possible interest in this arrangement lies in allowing the central tool to turn at an angular speed which is greater than the bit and in this way to obtain linear cutting speeds which are more uniform over the major part of the diameter of the drilled well.

In the drilling apparatus described in the patent (U.S. Pat. No. 4,862,974), the drilling apparatus completely joins together the base of the bit and the stator of the bottom engine.

Under these circumstances, power distribution is optimal only in the single case where the drilled ground and the cutting conditions to which both tools are subjected are such that the forward speeds which are made by both are identical when they are separately driven.

Any deviation in respect to this ideal situation manifests itself in a mediocre instantaneous power distribution and a problematical achievement of the hoped-for advantages.

One of the results envisioned by the invention is to remedy this disadvantage.

SUMMARY OF THE INVENTION

The drilling apparatus of the invention has a prismatic connection between the stator of the bottom engine and the base of the bit such as to permit the relative translation between the two tools along their common axis.

For the automatic control of this relative axial displacement, any means having resilience and which we call a spring, is interposed between the stator of the bottom engine and the base of the bit in such a way that the stator restrains this spring when the central tool has a tendency to slow down in respect to the bit during their respective forward movements.

To complete the efficiency of the thus conceived system, the stator of the bottom engine and the base of the bit have, in a shape which is delimited between them, an orifice with a profile which is a function of their relative positions and allowing the deviation of a variable part of the mud output, which in this way avoids the inlet orifice of the bottom engine.

The drilling apparatus modifies the deviation orifice in such a way as to increase the output admitted to the motor when the relative axial displacement of the stator takes place in a direction where it tends to constrain the spring and vice versa.

Finally, to avoid that the bottom engine could act as a pump if, for whatever reason, the speed of rotation of the central tool falls below that of the bit, it is possible to interpose a free wheel between the base of the central tool and the bit.

Obviously this free wheel is of a type which makes it impossible for it to run counter to the relative axial displacement of the two tools, and it is mounted in a way as to lock up when the absolute rotational speed of the central tool tends to become less than that of the bit.

The advantages of the drilling apparatus of the invention are the following:

- it gives both tools the same average forward speed without giving them in an inopportune manner the same instantaneous forward speeds,
- at the bottom of the hole it automatically recognizes the changes in drilling conditions imposed on each one of the tools by reason of variations in the resistance of the ground and in this way allows under all circumstances an expedient instantaneous distribution of the available power; in this way, if the central tool tends to fall behind in its forward movement and its rotation is slowed, the spring controls the increase in the load on the central tool and the simultaneous relief of the bit, while the throttling of the outflow of the mud by the variable orifice increases the available hydraulic power by means of the bottom engine: this allows the motor to deliver a much higher torque and the apparatus to react flexibly to the slowing down of the central tool,
- it makes it possible to join the two tools automatically in rotation without interrupting the drilling in progress when for whatever reason the bottom engine is stopped or does not have the necessary power to make the apparatus function under normal conditions.

BRIEF DESCRIPTION OF DRAWINGS

FIG. 1 shows an axial section through the drilling apparatus.

FIG. 2 shows on an enlarged scale a partial section II—II of FIG. 1 (the motor being shown above without being in section).

FIG. 3 shows an enlarged portion of the axial section shown in FIG. 1.

DETAILED DESCRIPTION OF DRAWINGS

Figure 1:
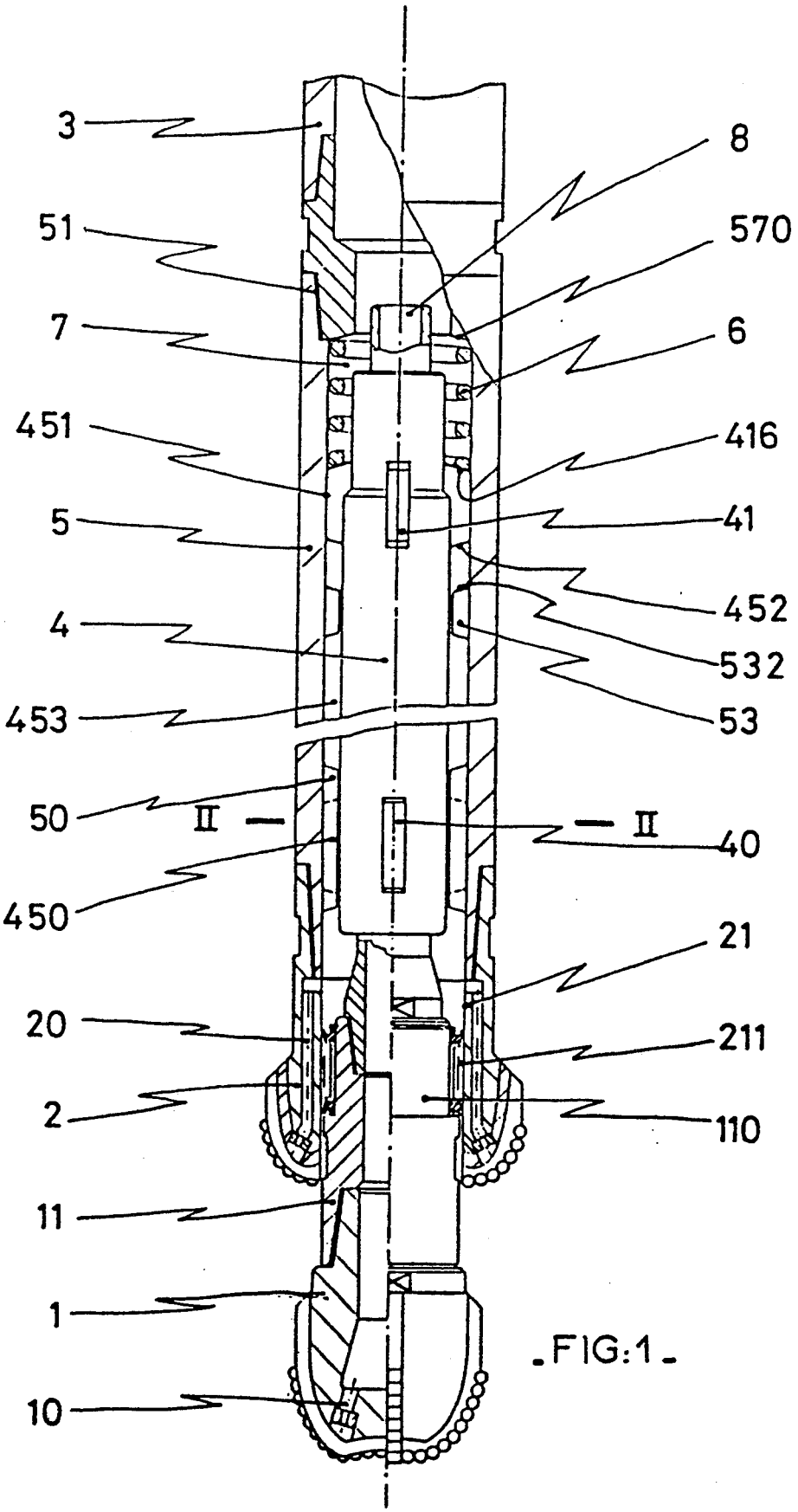
FIGS. 1 to 3 of the attached drawings illustrate by way of example an embodiment of the drilling apparatus of the invention, in which all the above recited arrangements are shown.
Figure 2:
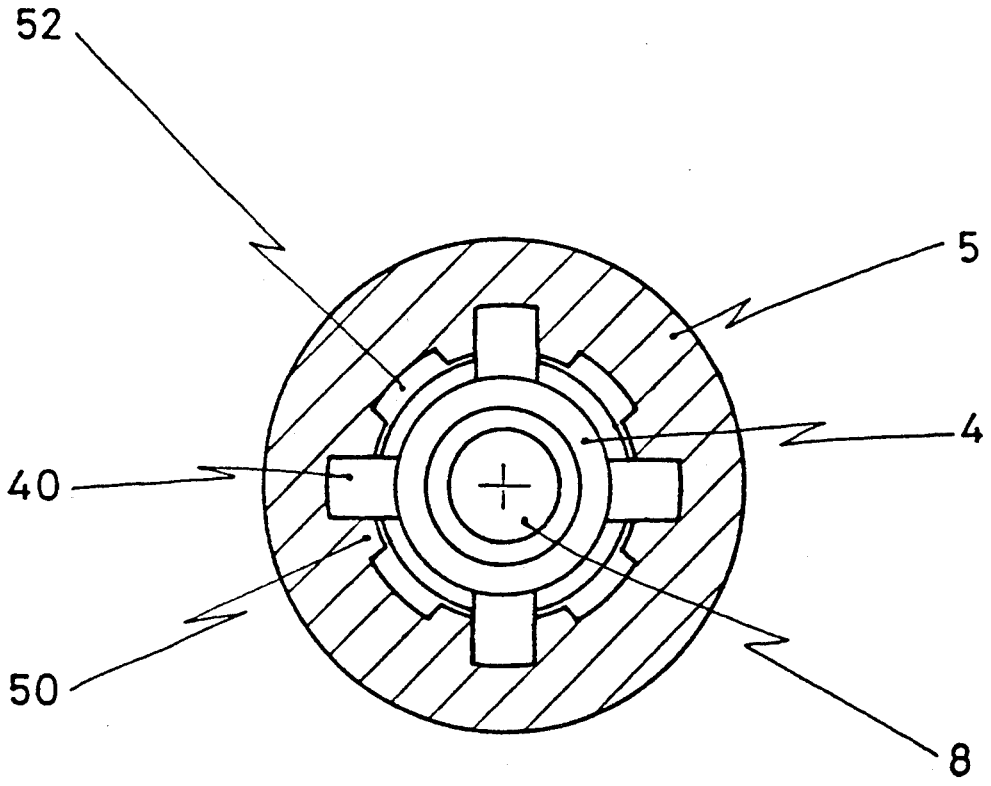
Figure 3:
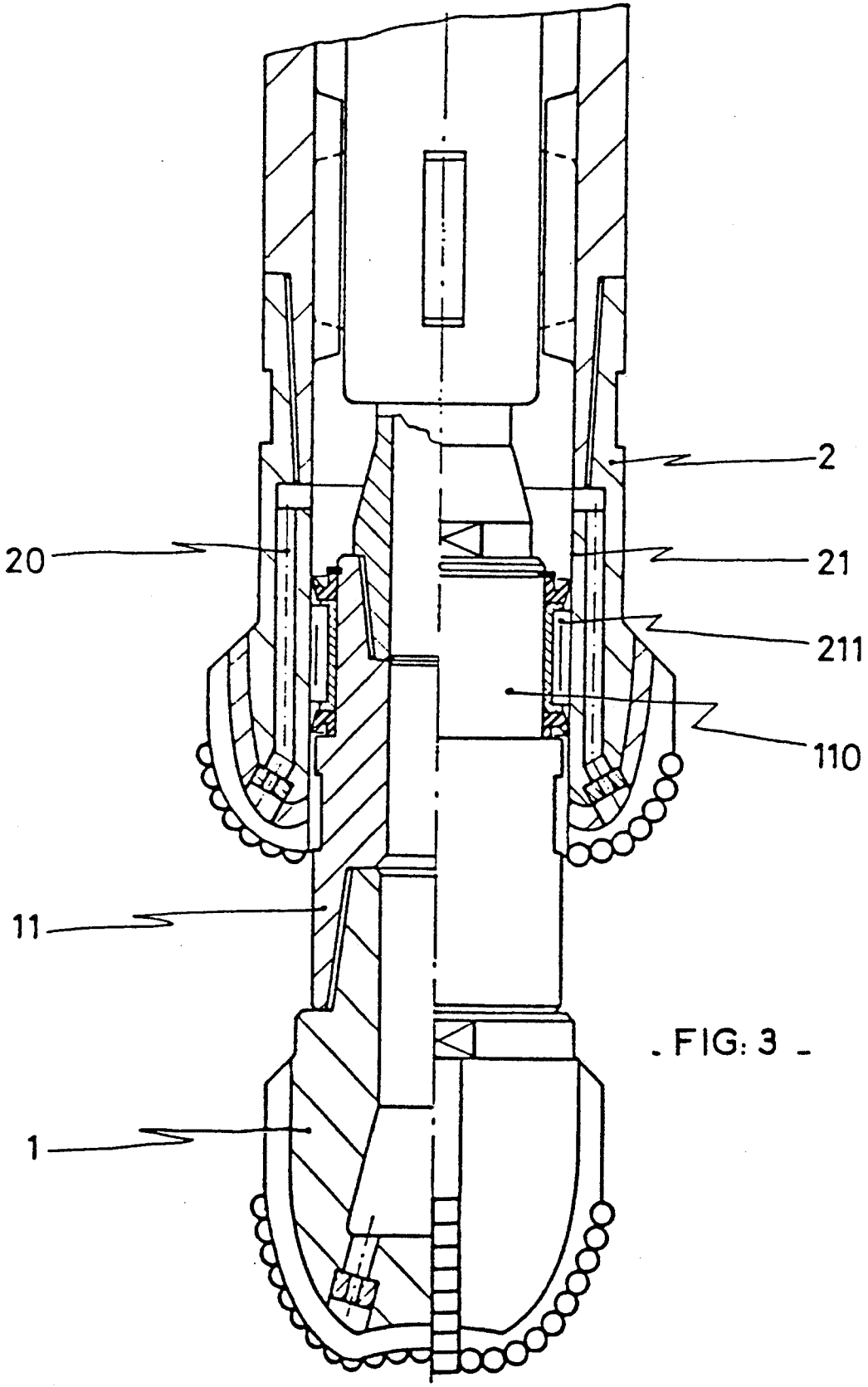

In these drawing figures the central tool 1 can be seen, driven rotationally by a bottom engine identified by its stator 4, in the same way as the bit 2 and its base 5 driven from the surface by the rods 3 of a drill gear which is part of a rotary system.

The apparatus has a prismatic connection 450 between the stator 4 of the bottom engine and the base 5 of the bit.

Here the base is of two pieces held together by the conical thread 51.

In this case the prismatic connection 450 is embodied as a fluting having four teeth 40 on the stator, which are engaged by the teeth 50 which are part of the base 5 of the bit.

The spring 6 which works under compression rests at 570 on the base of the bit and, at 416, on four projections 41 of the stator 4, wherein the upper surfaces of these projections form, at 451, a complementary cylindrical guidance for the stator on the base of the bit.

On the other end, the projections 41 of the stator 4 have support faces 452 which, together with the support faces 532 on the projections 53 of the base 5 of the bit, can constitute an abutment, which allows the extraction of the apparatus from the well without losing a part.

The orifice 7, through which the mud deflected to the inlet orifice 8 of the bottom engine passes, is constricted by the stator 4 of the bottom engine, when the latter compresses the spring 6, in such a way that an amount of mud crossing it is at that time admitted to the motor through its inlet orifice 8.

The amount of mud which has crossed the orifice 7 circulates in the annular space 453 between the base 5 of the bit and the stator 4 of the bottom engine, traverses the orifices 52 which constitute restrictors, then traverses the bit and reaches the well through the orifices 20 recessed in the body of the bit.

The amount of mud which was admitted to the motor through the orifice 8 traverses the motor and provides it with energy and finally escapes into the well through the orifices 10 recessed in the central tool.

The drilling apparatus also comprises a free roller wheel (211) interposed between the surface 21 of the bore of the base of the bit 2 and a seat of the base 11 of the central tool 1.

This free wheel has been mounted in such a way that it locks when the absolute rotating speed of the central tool tends to fall below that of the bit.

I claim:

1. A petroleum, gas or geothermal drilling apparatus comprising a central tool (1) and a coaxial bit (2), wherein the central tool (1) is driven by the rotor of a bottom engine which is fed by the drilling mud and wherein the bit (4) is driven from the surface by the rods (3) of a drill gear which is part of a rotary system, these same rods subjecting the apparatus to an axial load, this drilling apparatus being characterized in that it comprises a prismatic connection (450) between the stator (4) of the bottom engine and the base (5) of the bit, which allows the relative axial displacement of the two tools, and that a resilient means (6) is interposed between the stator (4) and the base (5) in such a way as to form a constraint on the stator when the central tool tends to fall behind in respect to the bit during their respective forward movements, so as to control the relative axial displacement of the two tools and to distribute between them, as a function of the displacement, the axial load to which the apparatus is subjected.

2. A drilling apparatus in accordance with claim 1, characterized in that the stator (4) of the bottom engine and the base (5) of the bit have, in a shape which is delimited between them, an orifice (7) with a profile which is a function of their relative positions, by which orifice (7) the mud is deflected to the inlet orifice (8) of the motor in such a way as to increase the output admitted to the motor when the relative axial displacement of the stator takes place in a direction where it tends to constrain the spring (6) and vice versa.

3. A drilling apparatus in accordance with claim 2, characterized in that a free wheel (211) of a type allowing the relative axial displacement of the two tools is interposed between the base (11) of the central tool (1) and the bit (2) and mounted in such a way that it locks when the absolute rotating speed of the central tool tends to fall below that of the bit.

4. A drilling apparatus in accordance with claim 1, characterized in that a free wheel (211) of a type allowing the relative axial displacement of the two tools is interposed between the base (11) of the central tool (1) and the bit (2) and mounted in such a way that it locks when the absolute rotating speed of the central tool tends to fall below that of the bit.

* * * * *

UNITED STATES PATENT AND TRADEMARK OFFICE

CERTIFICATE OF CORRECTION

PATENT NO. : 5,343,964

DATED : September 6, 1994

INVENTOR(S) : LEROY, Andre

It is certified that error appears in the above-identified patent and that said Letters Patent is hereby corrected as shown below:

On the cover page and column 1:

In the title: Change "Driling" to -- Drilling --;

Add the following information after the filing date:

PCT Filed: April 3, 1992

PCT No.: PCT/EP92/00771

§ 371 Date: December 10, 1993

§ 102(e) Date: December 10, 1993

PCT Pub. No.: WO92/18740

PCT Pub. Date: October 29, 1992

Signed and Sealed this

Twenty-ninth Day of November, 1994

*Attest:*

Bruce Lehman

BRUCE LEHMAN

*Attesting Officer*

*Commissioner of Patents and Trademarks*